US005575304A

United States Patent [19]

Hassett

[11] Patent Number: 5,575,304

[45] Date of Patent: Nov. 19, 1996

[54] VACUUM SEWER SYSTEM

[75] Inventor: Alan F. Hassett, Berwyn, Pa.

[73] Assignee: Environmental Resources Management, Exton, Pa.

[21] Appl. No.: 421,392

[22] Filed: Apr. 13, 1995

[51] Int. Cl.[6] ..... E03B 5/00

[52] U.S. Cl. ..... 137/1; 137/205; 137/236.1

[58] Field of Search ..... 4/323; 137/1, 205, 137/236.1, 396, 403, 907

[56] References Cited

U.S. PATENT DOCUMENTS

| | | | |
|---|---|---|---|
| 3,239,849 | 3/1962 | Liljendahl . | |
| 3,643,265 | 2/1972 | Wiswell, Jr. . | |
| 3,686,693 | 8/1972 | Liljendahl | 137/205 X |
| 3,746,032 | 7/1973 | Wallgren | 137/205 |
| 4,108,192 | 8/1978 | Michael . | |
| 4,155,851 | 5/1979 | Michael . | |
| 4,179,371 | 12/1979 | Forman et al. | 137/236.1 X |
| 4,184,506 | 1/1980 | Varis et al. | 137/205 |
| 4,232,409 | 11/1980 | Van Pham . | |
| 4,246,925 | 1/1981 | Oldfelt . | |
| 4,333,487 | 6/1982 | Michael . | |
| 4,357,719 | 11/1982 | Badger et al. . | |
| 4,376,444 | 3/1983 | Michael . | |
| 4,603,709 | 8/1986 | Huisma . | |
| 4,791,949 | 12/1988 | Tank . | |
| 4,928,326 | 5/1990 | Olin et al. . | |
| 5,100,266 | 3/1992 | Ushitora et al. . | |
| 5,114,280 | 5/1992 | Ushitora et al. . | |
| 5,133,853 | 6/1992 | Mattsson et al. . | |
| 5,165,457 | 11/1992 | Olin et al. . | |
| 5,214,807 | 6/1993 | Terve . | |

*Primary Examiner*—Gerald A. Michalsky

*Attorney, Agent, or Firm*—Lerner, David, Littenberg, Krumholz & Mentlik

[57] ABSTRACT

A vacuum sewer system and a method of operating such system is disclosed. The system includes a sewage holding tank and a lateral flow line and a vacuum valve associated with the holding tank for permitting a quantity of wastewater to be drawn out of the holding tank by a vacuum environment. The wastewater is drawn through the lateral flow line and a main pipeline to a desired collection location. A plurality of air inlet valves are arranged at spaced locations along the main pipeline for facilitating the flow of wastewater through the lateral flow line so that a large volume of the wastewater can flow through the lateral flow line in a given time.

33 Claims, 2 Drawing Sheets

VACUUM SEWER SYSTEM

FIELD OF THE INVENTION

The present invention relates to vacuum sewer systems. More particularly, the present invention relates to a vacuum sewer system including a vacuum valve which will permit substantially only sewage to flow from a sewage holding tank into a vacuum environment wherein the rate of sewage flow is enhanced by utilizing a plurality of air inlet valves spaced along the main pipeline of the sewer system.

BACKGROUND OF THE INVENTION

Several types of wastewater collection systems are utilized in commercial and residential environments. These systems include a conventional gravity sewer flow system, a pressurized system which utilizes positive pressure pumps to facilitate sewage flow and vacuum sewer systems.

In a conventional gravity sewer system, the gravitational forces are utilized to induce sewage flow. The structure of a gravity sewer system must be such that the liquid flows from an initial storage tank at a relatively high elevation to a sewage collection area at a lower elevation. The pipeline in a gravity sewer system must have a sufficiently steep slope so that the sewage and water flows therethrough with enough velocity to create a self-cleansing affect. Gravity sewer systems are not cost effective wherein the topography is such that the pipeline cannot be arranged at a sufficiently steep slope to accommodate the required sewage flow.

Positive pressure sewer systems may be used in certain environments wherein gravity sewer systems are not cost effective. Positive pressure sewer systems require the use of one or more pumps located at various wastewater input points so that sewage flow may be maintained by pumping the sewage into a network of relatively small diameter pipelines. Positive pressure systems can also be used in conjunction with a gravity system wherein at least one check valve is arranged at each pump location to serve at the interface between the gravity system which may be utilized at an individual residence and the pressurized system which may be arranged at a remote location, such as under a nearby street.

The third major type of a wastewater treatment system is a vacuum sewer system which may also be referred to as a negative pressure system. In its simplest form, it may include a vacuum collection tank and a vacuum pump located at a collection or pumping station, an initial sewage holding tank, a main pipeline for transporting the sewage from the holding tank to the collection station, and a vacuum valve arranged between the sewage holding tank and the main pipe line. A lateral pipeline which usually has a smaller inner diameter than the main pipeline is arranged between the vacuum valve at the sewage holding tank and the main pipeline.

The vacuum valve may be electrically or pneumatically operated and usually serves as an interface between a conventional gravity plumbing system which may be used to transport sewage to the sewage holding tank and the vacuum portion of the sewer system. Prior art vacuum sewer systems required that a predetermined ratio of wastewater, which may contain both liquid and solid sewage within a water or chemical-based medium, and air be drawn from the sewage holding tank and the outside environment into the main vacuum pipeline. The wastewater and the air were then forced downstream toward the sewage collection station by the pressure differential between the sewage collection tank and the sewage holding tank. The pressure differential exists due to the evacuation of air from the collection tank by using vacuum pumps, such that the collection station end of the main sewage pipeline is at a lower absolute pressure than the atmospheric pressure which normally exists in the sewage holding tank. In other words, the pressure differential creates a hydraulic energy gradient from the sewage holding tank toward the collection station. The hydraulic energy differential drives the wastewater through the open vacuum valve and the connected lateral line and into the main vacuum pipeline towards the collection station.

Operation of vacuum sewer systems is limited by the total pressure differential which may be created between the collection station and the atmospheric pressure at the sewage holding tank. The theoretical upper limit of the pressure differential is between the existing barometric pressure and absolute vacuum. This limit may be quantitatively defined as 760 mm Hg which is approximately equivalent to the pressure exerted by one atmosphere, or 34 feet of water. Practically, this upper limit of the pressure differential cannot be obtained as absolute vacuum is an ideal state. Typical pressure differentials in conventional vacuum sewer systems range between 200–600 mm Hg.

The air that was admitted by the vacuum valve into the associated piping network was necessary to facilitate the flow of wastewater through the system. However, the air took up a certain volume which effectively limited the volume of wastewater which could be drawn into the sewage pipeline at a given time.

In certain prior art systems, an air inlet valve was arranged at remote locations along the main pipeline to facilitate the wastewater flow through problem areas on the pipeline, such as "sags" and "high lift" regions. The sags resulted due to the profile of the associated pipeline which followed the ground surface contour. A sag may result when the pipeline directs the wastewater flow at a downhill angle and then requires the wastewater to flow slightly uphill. A sag may be considered the radius area between the downhill and the uphill slope of the pipeline. The pipeline may retain wastewater in these sags, thus hindering overall wastewater flow. The use of an air inlet valve at a sag region in the pipeline was found to be efficient to force the wastewater which may otherwise be retained in the sag to flow through the pipeline.

With regard to a high lift application, it was found that the use of an air inlet valve at a location along a main pipeline that extended upwardly at a relatively steep angle, helped to facilitate the flow of wastewater through the pipeline at the high lift region.

In conventional vacuum sewer systems, where both air and wastewater are conveyed through the lateral lines, the flow rate of wastewater through the lateral sewage pipeline is typically limited to approximately 15 gallons per minute (GPM). This flow rate may be inadequate for various commercial and residential applications which require handling of large amounts of wastewater. The present invention overcomes the problems associated with inadequate wastewater flow through lateral and main pipelines of a vacuum sewer system.

SUMMARY AND OBJECTS OF THE INVENTION

In accordance with a first aspect of the present invention, a method of operating a vacuum sewer system for withdrawing wastewater from a sewage holding tank through a lateral flow line and into a main pipeline is provided. The method preferably comprises the steps of creating a vacuum environment in the main pipeline and the lateral flow line. Selectively subjecting the wastewater within the sewage holding tank to the vacuum environment for a period of time sufficient to force substantially only wastewater retained within the sewage holding tank to flow into the lateral flow line but insufficient to permit an appreciable amount of air to flow therewith. Air may then be selectively admitted directly into the main pipeline to increase the volume per unit time of the wastewater flowing in the lateral flow line.

When performing the step of creating a vacuum environment, it is preferable to activate at least one vacuum pump that is connected to the main pipe line until the predetermined vacuum environment is created within the main and lateral lines. Preferably, the vacuum environment created within the main and lateral lines is between 200 mm Hg and 600 mm Hg.

In a preferred embodiment, a programmable logic controller (PLC) is used to perform the steps of selectively opening and closing the vacuum valve means. This is accomplished by sending control logic signals from the PLC at predetermined timed intervals to the vacuum valve means. The PLC may also be used to perform the steps of selectively opening and closing the plurality of air inlet valve means. In accordance with these steps of the present method, control signals may be sent from the PLC at predetermined timed intervals to selected ones of the plurality of air inlet valve means.

In another preferred embodiment, level detection means may be used to ascertain when the vacuum valve means should be opened or closed to allow substantially only wastewater stored within the sewage holding tank to be exposed to the vacuum environment. The level detection means may comprise a floating-type sensor, a pneumatic device such as a bubbler system, an ultrasonic detection device or the like. The level detection means may operate in conjunction with a PLC, or may operate independent of the PLC. In an embodiment which uses level detection means, a control signal is generated to actuate the vacuum valve means to open when the level of wastewater within the sewage holding tank reaches a predetermined value. In this embodiment, a control signal is also sent to the vacuum valve means to effect closing thereof when the level of wastewater within the sewage holding tank goes below a predetermined value.

The method of operating the present vacuum sewer system may also include the step of actuating the vacuum valve means to cycle between open and closed positions until a desired amount of wastewater initially stored within the sewage holding tank has been evacuated therefrom.

A PLC may be used to automatically activate associated vacuum pumps to create a desired vacuum environment when the wastewater within the sewage holding tank reaches a predetermined level. This may be the same PLC used to selectively open and close the vacuum valve means and the plurality of air inlet valve means.

The present method could also be operated with a sewer system which is a combination of a gravity plumbing system and a vacuum system. In this environment, the method may include the steps of selectively transporting wastewater under a gravity flush system from an initial storage tank through corresponding gravity lateral lines into the sewage holding tank prior to exposure to the vacuum environment which occurs upon actuation of the vacuum valve means to an open position.

In accordance with another aspect of the present invention, a vacuum sewer system is provided. The vacuum sewer system preferably comprises a sewage holding tank and vacuum valve means which is normally arranged in a closed position and is selectively actuated to an open position. The vacuum valve means is operatively connected for fluid flow with respect to the sewage holding tank to selectively permit substantially only wastewater stored within the sewage holding tank to flow therefrom while preventing any appreciable amount of air from flowing out of the sewage holding tank. Lateral flow line means are provided for transporting wastewater out of the sewage holding tank. The vacuum valve means is connected to the lateral flow line means and is operatively associated therewith. The vacuum valve means may be arranged either upstream or downstream of the lateral flow line means. A main pipe line is arranged downstream of the lateral flow line means and is adapted to receive wastewater flowing therefrom. Vacuum generating means are provided for generating a vacuum environment within the main pipeline and the lateral flow line means. A plurality of air inlet valve means are arranged at spaced locations along the main pipeline and are selectively actuatable from a closed to an opened position and vice versa for selectively permitting ambient air to be drawn into the main pipeline by the vacuum environment therein, whereby the capacity in terms of the volume per unit time for wastewater flowing within the lateral flow line means is increased from an initial amount to a greater amount.

The lateral flow line means may comprise a flexible hose which may be connected to the sewage holding tank and a fixed lateral flow line, which may comprise a substantially rigid structure, and which may be arranged adjacent the main flow line. In this preferred embodiment, the vacuum valve means may be arranged between the fixed lateral flow line and the flexible hose.

The flexible hose may be removably connected with respect to the sewage holding tank. In another preferred embodiment, the flexible hose may also be removably connected with respect to a vacuum valve arranged between the flexible hose and the fixed lateral flow line which is connected directly to the main flow line.

As used herein, the term ambient air is considered to be atmospheric air which is present outside of the main and lateral pipelines. Thus, when the air inlet valve means are placed in an open position, atmospheric air is drawn from the outside environment into the main pipeline. It should also be appreciated that the term wastewater is considered to comprise various liquids including industrial wastewater, storm water, industrial process liquids as well as sewage wastewater.

Preferably, the vacuum sewer system comprises a plurality of sewage holding tanks and a plurality of lateral flow lines connected to respective ones of the plurality of sewage holding tanks. Each of the plurality of lateral flow lines is connected to a main pipeline.

The vacuum sewer system also preferably comprises a collection tank arranged downstream of the main pipeline which is adapted to receive the wastewater evacuated from the sewage holding tank. The collection tank may be operated in conjunction with the vacuum generating means, which may comprise at least one vacuum pump, so that the vacuum environment is between about 200 mm Hg and 600 mm Hg.

It is preferable for the vacuum valve means to comprise a solenoid in combination with a valve member, such as a pinch valve, check valve, ball valve or the like. The solenoid is operatively connected to the valve member and is responsible for actuating the valve member to a desired open and closed position. Each of the plurality of air inlet valve means may comprise a solenoid valve or other electrically, hydraulically or pneumatically operated valve member.

The vacuum sewer system of the present invention preferably includes controller means for controlling actuation of the vacuum valve means between the open and closed position. The controller means may comprise a PLC which is adapted to send control logic signals to the vacuum valve means. The controller means may also be used to control actuation of the plurality of air inlet valve means between the desired open and closed positions.

It is also preferable for the vacuum sewer system to comprise a plurality of initial storage tanks and a plurality of corresponding gravity lateral lines wherein each of the gravity lateral lines has a first end connected to corresponding ones of the initial storage tanks and a second end connected to the sewage holding tank. In this embodiment, the vacuum valve means serves as an interface between a gravity system and a vacuum sewer system.

The main pipeline may have an inner diameter of between about three inches and twelve inches. The lateral flow line may have an inner diameter of between about one inch and four inches. In alternate embodiments, the dimensions of the main pipeline and the lateral sewage flow lines may vary to accommodate desired amounts of sewage flow.

The main pipeline of the present vacuum sewer system is preferably arranged in a saw-tooth pattern. Further, at least a portion of the main sewage flow line may be arranged below ground and preferably slopes from the sewage holding tank to a collection station except for vertical portions of the saw-tooth pattern.

The period of time that the vacuum valve means is arranged in an open position may vary depending upon the amount of wastewater within an associated sewage holding tank and the type of vacuum sewer system used. In accordance with one embodiment, such as a particular vacuum sewer system that may be used in connection with emptying sewage holding tanks from railcars, an operator may manually determine the amount of wastewater left within a sewage holding tank. In this embodiment, the operator manually determines how much wastewater remains to be emptied from an associated sewage holding tank and then effects opening and/or closing of an associated vacuum valve.

In another preferred embodiment, the period of time that the vacuum valve is open may be automatically calculated by a PLC. In another preferred embodiment, the period of time that a vacuum valve remains open or closed may be automatically determined by a level detection device, which may work in conjunction with a PLC or independent of a PLC, which causes opening of an associated vacuum valve when wastewater within a holding tank reaches a predetermined high level and automatically causes closing of the associated vacuum valve when the wastewater in the holding tank reaches a predetermined low level.

Accordingly, it is an object of the present invention to provide a vacuum sewer system which includes vacuum valve means arranged between a sewage holding tank and a main pipeline which may be opened for a period of time so that substantially only wastewater is permitted to flow from the holding tank into the main pipeline.

It is another object of the present invention to provide a vacuum sewer system which includes a plurality of air inlet valve means arranged at spaced locations along a main pipeline so that ambient air may be selectively drawn therein to increase the volume of wastewater flow in a given time period within one or more associated lateral flow lines.

It is another object of the present invention to provide a novel method of operating a vacuum sewer system which will permit a substantially greater volume of sewage to flow through associated lateral flow lines in a given time period than has heretofore been achieved.

These objects and other objects and features of the present vacuum sewer system and method of operating a vacuum sewer system will be more apparent after considering the following detailed description of the preferred embodiments in conjunction with the drawings which form part of the disclosed invention.

DETAILED DESCRIPTION OF THE PREFERRED EMBODIMENTS

Figures 1, 2:
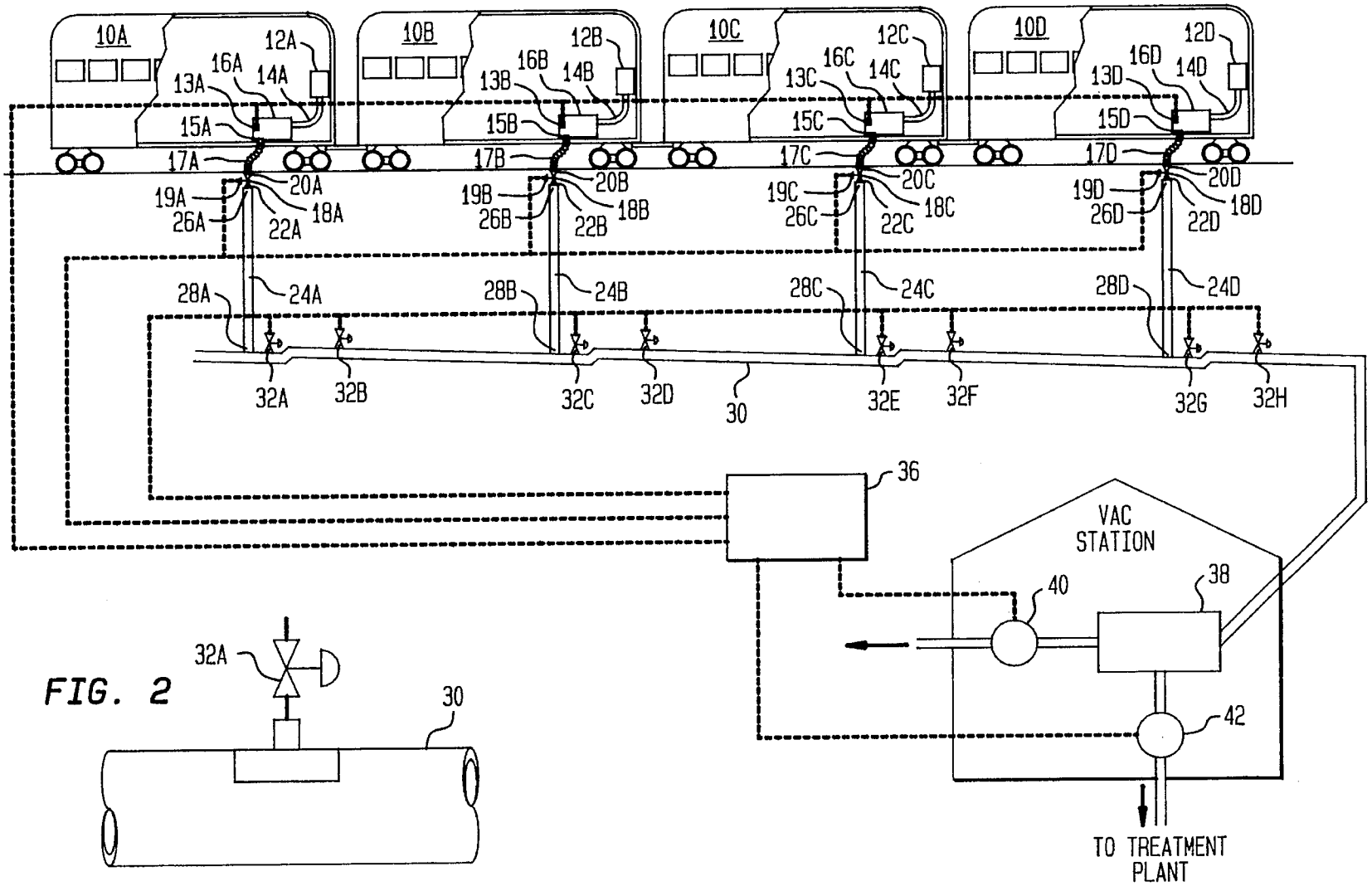
FIG. 1 is a schematic view of one preferred embodiment of the vacuum sewer system of the present invention.
FIG. 2 is a schematic detailed view of the arrangement of one of the air inlet valves of the present invention in combination with the main pipeline.

A vacuum sewer system in accordance with the present invention is schematically shown in FIG. 1 in combination with a gravity-fed sewer system which may be used in commercial or residential environments. FIG. 1 particularly illustrates the present vacuum sewer system as it may be used to empty rail cars. However, it should be appreciated that the present vacuum sewer system may be used in various applications for removing sewage from restaurants, factories, office buildings, schools, residential homes, etc.

A plurality of rail cars are identified by reference numerals 10A–D in FIG. 1. Each of the rail cars 10A–D include a conventional gravity sewage system including a toilet 12A–D, a gravity-fed lateral flow line 14A–D and a storage tank 16A–D. The gravity-fed lateral flow lines are connected between the toilets 12A–D and the storage tank 16A–D. These gravity sewer system components are well known in the art.

The present invention includes at least one vacuum interface valve 18A–D, which serves as an interface between a conventional gravity-fed system, and a novel vacuum sewer system. The vacuum interface valves 18A–D are associated with each of the storage tanks 16A–D. The vacuum interface valves 18A–D may be selectively actuated between an open and closed position by a corresponding solenoid 19A–D. In a preferred embodiment, the vacuum interface valves 18A–D may be pinch valves and the overall valve assembly includes a combination of the pinch valves and the corresponding solenoids 19A–D. It should be appreciated that in alternate embodiments a single unit solenoid valve or other valve assemblies may be used in place of the composite pinch valve and solenoid arrangement.

Manual valves 15A–D are arranged on the holding tanks 16A–D along with quick disconnect couplings (not shown) for connecting associated lateral flow lines to the holding tanks 16A–D. In a preferred embodiment, such as an embodiment used to remove wastewater from sewage holding tanks on railcars, the lateral flow lines may comprise multiple components such as selectively removable flexible hose portions 17A–D and fixed substantially rigid components 24A–D which are directly connected to the main sewer pipeline 30. The flexible hoses 17A–D have a first end which may be connected to quick disconnect couplings at the manual valves 15A–D of the holding tanks 16A–D. A second end of the flexible hoses 17A–D is arranged downstream of the first end and may be connected to the upstream end 20A–D of the vacuum interface valves 18A–D as shown in FIG. 1. A downstream end 22A–D of the vacuum interface valves 18A–D is spaced from the upstream end 20A–D. It should be appreciated that the distance between the upstream and downstream ends of the vacuum interface valves may be a very small distance. The distinction between the upstream and downstream end has been made to more particularly define the portions of the vacuum interface valve 18A–D that are closest to the sewage holding tank 18A–D and the associated fixed lateral flow lines.

Although various types of vacuum interface valves may be used in accordance with the present invention, an air-operated pinch valve has proven reliability in vacuum service. This valve may have a straight-through full bore which is ideal for undiluted toilet waste service. When coupled with the solenoids 19A–D, the vacuum interface valves 18A–D function as an electrically operated vacuum valve which is reliable and simple to maintain.

As shown in FIG. 1, fixed lateral flow lines 24A–D are provided and have an upstream end 26A–D connected to the downstream end 22A–D of corresponding vacuum interface valves 18A–D. The fixed lateral flow lines 24A–D also have a downstream end 28A–D which is secured to a main pipeline 30. It is preferable for the lateral flow lines 24A–D to be made of a substantially rigid material, such as schedule 40 PVC (polyvinylchloride) PVC pipe.

The particular dimensions, including the length and inner diameter of the fixed lateral flow lines 24A–D, may vary in alternate embodiments. In a preferred embodiment, the fixed lateral flow lines 24A–D may have an inner diameter of between about two inches and four inches. However, in alternate embodiments, larger or small diameter flow lines may be used. Similarly, the flexible lateral flow lines 17A–D preferably have an inner diameter of between about two inches and four inches, but may have a larger or smaller diameters depending upon the particular application for which they are used.

Couplings (not shown) may be used to connect an upstream end of the fixed lateral flow lines 24A–D between the vacuum interface valves 18A–D and the main sewer pipeline 30. The couplings should have a structure which is sufficient to operate in a vacuum environment of between about 200 mm Hg and 600 mm Hg.

It is preferable for the lateral flow lines 17A–D to be made of a substantially flexible hose-like material so that emptying of the sewage holding tanks 16A–D of the railcars 10A–D may be performed when the railcars 10A–D are in various positions with respect to the coupling areas of the vacuum interface valves 18A–D and the fixed lateral flow lines 24A–D.

As illustrated in FIG. 1, the main sewer pipeline 30 may have a saw-tooth profile. This is a hydraulically efficient profile as it enhances the flow rate of wastewater through the main pipeline 30 and it permits the main pipeline 30 to remain shallow beneath the ground surface. It is preferable for the main pipeline 30 to have an overall slope toward a central vacuum collection station. This slope may vary depending upon the environment. However, it has been found that an overall slope of at least two feet per 1000 feet of pipeline is preferable.

The main pipeline 30 may be constructed of various corrosion-resistant materials. In a preferred embodiment, the main pipeline 30 is a PVC pipe which has an inner diameter of between about four inches and twelve inches. It should be understood that the inner diameter of the PVC pipe may vary in particular applications and thus may be smaller or larger than the aforementioned dimensions.

A plurality of air inlet valves 32A–H are connected at spaced distances along the main sewer pipeline 30. Each of the air inlet valves 32A–H may be a solenoid operated valve member that can be selectively moved between the open and closed positions. The distance between the air inlet valves is preferably no more than about 1000 linear feet and may be less than about 200 linear feet. However, in alternate embodiments, the distance between the closest ones of the air inlet valves 32A–H may be greater than 1000 linear feet or substantially less than 200 linear feet.

The main sewer pipeline 30 is connected to a collection tank 38 which may be arranged at a vacuum station. A vacuum pump 40 is operatively associated with the collection tank 38 and the main pipeline 30. The vacuum pump may be an oil-cooled continuous-run rotary vane type pump which has been proven to be reliable in vacuum sewer applications. Alternatively, various other types of vacuum pumps may be used within the scope of the present invention. The vacuum pump 40 should be sufficient to create a vacuum environment of at least between about 200 mm Hg and 600 mm Hg with the main pipeline 30 and the associated lateral lines 24A–D.

A sewage pump 42 is connected to the collection tank 38 for pumping sewage from the collection tank 38 to a transport truck or a sewage treatment plant. Various types of sewage pumps may be used in accordance with the present invention. One conventional sewage pump which has been successfully used is a centrifugal pump which is typically used in submersible sewage lift stations and dry-pit applications and has net positive suction head characteristics suitable for vacuum sewer systems.

As schematically illustrated in FIG. 1, a PLC 36 may be connected to various components of the present vacuum sewer system to obtain control over the system. The PLC must be capable of controlling repetitive on-off sequencing operations. One commercially available PLC which is suitable for use with the present vacuum sewer system is the Allen Bradley 5/25 PLC.

As illustrated in FIG. 1, the PLC is coupled to the solenoids 19A–D for controlling the vacuum interface valves 18A–D, the air inlet solenoid valves 32A–H, the vacuum pump 40 and the sewage pump 42. In alternate embodiments, separate PLC's may be used to control various features of the present vacuum sewer system. However, in the preferred embodiment shown in FIG. 1, a single PLC controls the wastewater level in the system, the rate of sewage flow through the lateral flow lines 17A–D and 24A–D and the main flow line 30, and removal of wastewater from the collection tank 38.

Level detection devices 13A–D may be operatively associated with the sewage holding tanks 16A–D to detect high and low wastewater levels and to generate signals in response to such levels so that the associated vacuum interface valves 18A–D can open and close based on the level of wastewater within the sewage holding tanks 16A–D. The level detection devices 13A–D may operate on a float principal, a pneumatic principal such as a bubbler system, an ultrasonic principal or other level detection principles which are generally known in the art. The level detection devices 13A–D may operate in conjunction with the PLC 36 or may operate independent of the PLC 36.

In an embodiment where a PLC is not required, the level detection devices 13A–D may operate independent of a timer for effecting opening and closing of associated vacuum interface valves 18A–D. In such a vacuum sewer system, wastewater may flow substantially continuously from the holding tanks 16A–D provided that the level of wastewater which flows into the holding tanks 16A–D does not drop below a predetermined level. Such a vacuum sewer system may require handling of large amounts of wastewater.

In another embodiment, such as the emptying of railcars, it may desirable to limit the sewage flow with the vacuum sewer system. In this type of environment, it would be desirable to use a PLC to control the opening and closing of the vacuum interface valves 18A–D at timed intervals so that the vacuum interface valves would be considered throttled. For instance, it may be desirable to limit wastewater flow to 100 GPM. Throttling of the vacuum interface valves 18A–D may be preprogrammed in the associated PLC 36 so that the wastewater flow rate will never be permitted to exceed about 100 GPM.

One important aspect of the present invention pertains to actuation of the vacuum interface valves 18A–D which are designed to cycle in accordance with control logic signals sent by the PLC so that substantially only wastewater is drawn out of the storage tanks 16A–D. This is different from prior art vacuum interface valves which were generally designed to operate by allowing liquid sewage to be admitted from a storage tank to a lateral flow line for a predetermined period of time and then permitting a supply of air to be drawn into the associated flow lines. Various air to liquid ratios were required when using prior art vacuum interface valves. The prior art systems which used these two-phase vacuum interface valves were not as efficient as the present vacuum sewer system because the air admitted into the associated lateral lines displaced a certain amount of wastewater, thus limiting the amount of wastewater that could flow through the lateral lines at a given time. Such prior art systems usually obtained overall flow rates of less than about 15 gallons per minute (GPM) of liquid sewage for each vacuum valve used in conjunction with the lateral lines. Although the prior art systems perform satisfactorily in environments where relatively low flow applications are needed, they are not fully capable of meeting the demand of high flow environments unless a large number of vacuum valves are utilized.

By using vacuum interface valves 18A–D, which do not permit any appreciable amount of air to flow into the associated lateral lines 24A–D, in conjunction with the air inlet valves 32A–H, the flow rate of wastewater through the lateral lines 24A–D can be increased to well over 100 GPM and may reach in excess of 200 GPM. This advantageous aspect of the present invention will be discussed further below in connection with the operation of the present vacuum sewer system.

When operating the present vacuum sewer system in accordance with the present invention, an operator may be required to manually connect a first end of a flexible lateral flow line, such as lateral lines 17A–D, to the quick disconnect coupling (not shown) at the manual valves 15A–D of the sewage holding tanks 16A–D. A second end of the flexible lateral lines 17A–D would be connected to the upstream end 20A–D of the vacuum interface valves 18A–D. The downstream end 22A–D of the vacuum interface valves 18A–D is arranged adjacent the upstream end 26A–D of the fixed lateral flow lines 24A–D, which is fixed at the downstream end 28A–D to the main line 30.

Figure 3:
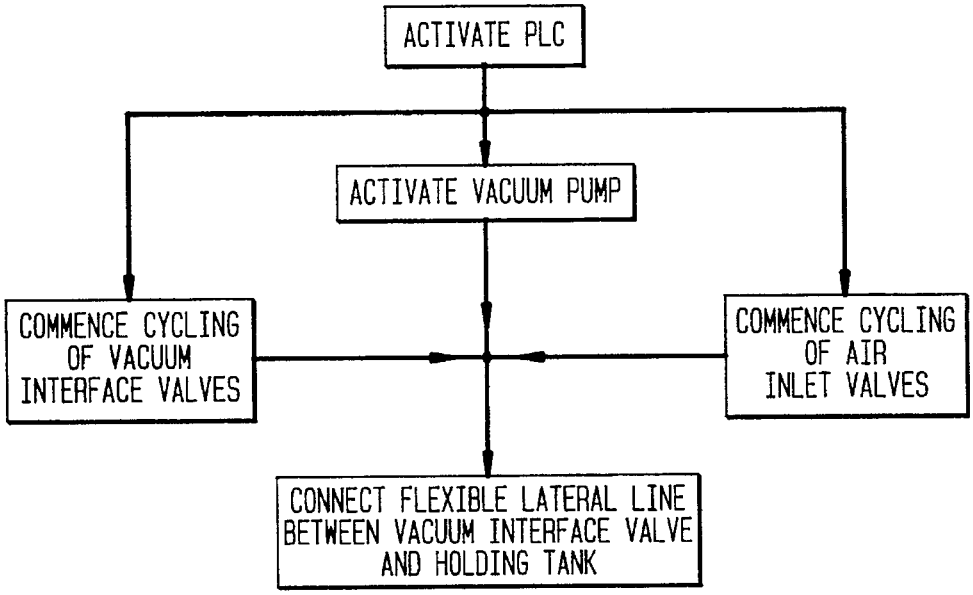
FIG. 3 iS a flow diagram indicating operational steps of the vacuum sewer system in accordance with the method of the present invention.

A flow chart depicting operation of the vacuum sewer system in accordance with the present method is shown in FIG. 3. It should be appreciated that the step of connecting the flexible lateral flow lines 17A–D between the sewage holding tanks 16A–D and the vacuum interface valves 18A–D may not be necessary in environments where the lateral flow lines 24A–D and the vacuum interface valves 18A–D are already connected between associated sewage holding tanks 16A–D and the main flow line 30, such as in environments wherein the sewage holding tanks 16A–D are not mobile.

Prior to connection of the flexible lateral flow lines 17A–D in assembled position, an operator may be required to push an initial activation button (not shown) which has the effect of activating the PLC 36 to operate the timing for all of the sewer interface valves 18A–D and the air inlet valves 32A–H. To this end, the PLC 36 sends control signals to the associated solenoids 19A–D of the vacuum interface valves 18A–D and the air inlet solenoid valves 32A–H. The PLC 36 may also simultaneously send a signal to the vacuum pump 40 which will activate the vacuum pump to create a predetermined vacuum environment within the main flow line 30 and the associated lateral flow lines 24A–D. As indicated above, this vacuum environment is preferably between about 200 mm Hg and 600 mm Hg.

For simplification purposes, the vacuum pump 40 is described as comprising a single vacuum pump. However, in actual operation, the vacuum pump 40 may comprise a lead vacuum pump and one or more secondary vacuum pumps. It may take several or more minutes for the vacuum pump 40 to obtain the desired vacuum environment within the main pipeline 30 and the lateral flow lines 24A–D. Once the desired vacuum environment has been obtained, and after the flexible lateral flow lines 17A–D have been connected into assembled position, cycling of the vacuum valves 18A–D and the air inlet valves 32A–H will commence.

A simplified view of the relationship between an air inlet solenoid valve 32A and the main sewer pipeline 30 is shown in FIG. 2. Although FIG. 1 depicts eight inlet air valves 32A–H spaced along the main sewer pipeline 30, it should be appreciated that the quantity of air inlet valves may vary depending upon the desired volume per unit time flow rate of wastewater within the lateral flow lines 24A–D. Since the vacuum interface valves 18A–D do not allow any appreciable amount of air to flow into the lateral flow lines 24A–D, the air inlet valves 32A–H are used to draw ambient air from the outside environment directly into the main sewer pipeline 30 while substantially only sewage is drawn into the main pipeline 30 through lateral flow lines 17A–D and 24 A–D. Each of the air inlet solenoid valves 32A–H are independently operated and controlled by the PLC. It has been found that it is advantageous to draw air into the main pipeline 30, as opposed to the lateral flow lines 24A–D because the main pipeline 30 has a larger inner diameter and thus, the ambient air drawn therein does not displace wastewater in the same way that it would within the lateral flow lines 24A–D.

Figure 4:
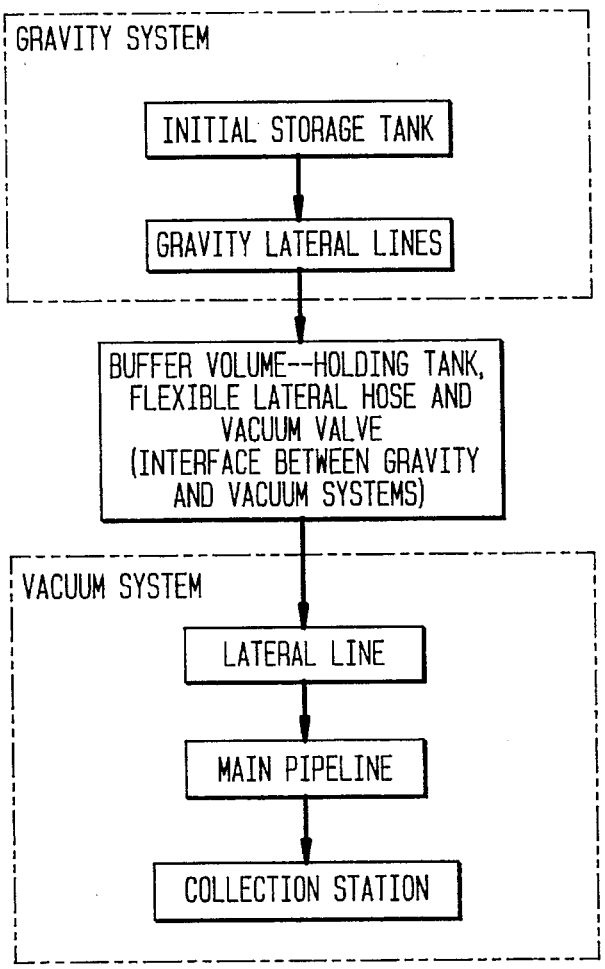
FIG. 4 is a flow diagram indicating wastewater flow regions in block format through the gravity and vacuum regions of the sewer system of the present invention.

The manual valves 15A–D are normally arranged in a closed position. These valves may be opened after the flexible lateral flow lines 17A–D are connected between the sewage holding tanks 16A–D and the upstream end 20A–D of the vacuum interface valves 18A–D. The gravity system components including the toilets 12A–D, the gravity lateral flow lines 14A–D and the sewage holding tanks 16A–D are thus isolated from the vacuum sewer system components including the lateral flow lines 24A–D, the main pipeline 30, the collection tank 38 and the vacuum pump 40. The frequency and the duration of time that the vacuum interface valves 18A–D are placed in an open position may vary depending on the physical location of the valves within the system. Thus, the open frequency and duration of the vacuum interface valves 18A–D are preferably individually adjustable between 0.1 seconds and about 10 minutes. Of course, the vacuum interface valves 18A–D can remain open for substantially longer periods of time in particularly high flow environments where continuous flow applications are required. The frequency parameters can be programmed into the PLC 36. An initial cycling period for the vacuum interface valves 18A–D may be 30 seconds open followed by 5 seconds closed for a total cycle period of 35 seconds. This will allow "slugs" of wastewater (a combination of liquid and solid sewage with water or other chemical-based liquid used to facilitate removal of the sewage) to flow from the holding tanks 16A–B through the flexible lateral lines 17A–D and the vacuum interface valves 18A–D and into the fixed lateral vacuum flow lines 24A–D. FIG. 4 illustrates a block diagram depicting the wastewater flow from the gravity system plumbing components through the vacuum interface valves 18A–D and into the vacuum system components.

When the vacuum interface valves 18A–D are activated by the PLC controlled solenoids 19A–D to an open position, the vacuum environment, which is the difference between the barometric pressure and the vacuum pressure created by the vacuum pump 40, draws wastewater from the storage tanks 16A–D into the lateral flow lines 17A–D and 24A–D. A sewage slug is then formed and is drawn into the main pipeline 30 where it passes the air inlet valves 32A–H. Cycling of the air inlet valves 32A–H has been commenced by the control signals sent by the PLC 36. The air inlet valves 32A–H are normally arranged in a closed position so that the vacuum environment created by the vacuum pump 40 within the main pipe line 30 is isolated from the outside environment. The open frequency and duration of the air inlet valves 32A–H is preferably individually adjustable between about 0.1 seconds and 60 seconds. If desired, the air inlet valves 32A–H can remain open for shorter or longer periods of time. This frequency time period can be programmed into the PLC 36 to allow for adjustments in the frequency and duration of the open position. A typical cycle of the air inlet valves 32A–H may be 5 seconds open followed by 25 seconds closed for a total cycle period of 30 seconds. Air is drawn in from the outside environment during the period of time that the air inlet valves 32A–H are in an open position to increase the volume per unit time of wastewater flowing within the lateral flow lines 24A–D.

The vacuum pump 40 evacuates air from the collection tank 38, the main pipeline 30 and the vacuum lateral lines 24A–D so that a pressure differential exists and the internal vacuum pressure is at a lower absolute pressure than the atmospheric pressure which exists in the ambient environment. This pressure differential creates a hydraulic energy gradient from the storage tanks 16A–D towards the collection tank 38 upon opening of the manual valves 15A–D and the vacuum interface valves 18A–D. This drives the wastewater which is drawn into the flexible and fixed lateral flow lines 17A–D and 24A–D toward the collection tank 38. The air which is drawn in from the ambient environment through the air inlet valves 32A–H greatly increases the volume per unit time of wastewater flowing through the lateral lines 24A–D. To this end, wastewater admitted into the lateral flow lines 24A–D can be forced to flow at rates substantially greater than 100 GPM. This is a remarkable increase over prior art systems which obtain flow rates of up to about 15 GPM when a similar number of vacuum interface valves are used.

As the wastewater is continuously drawn towards the collection tank 38, it may be completely evacuated from the storage tanks 16A–D. When the level of wastewater drawn into the collection tank 38 exceeds a predetermined level, the PLC 36 or associated level detection devices 13A–D will actuate the associated sewer pump 42 so the sewage within the collection tank 38 will be pumped into a sewage truck for transportation to a treatment plant, or may be transported into an associated pipeline for direct pumping to a sewage treatment plant.

After completing the method for removing the wastewater from storage tanks 16A–D, the operator can either manually shut off the power to the associated vacuum sewer system or the PLC may be programmed to detect completion of the sewage transport operations so that power to the system is automatically shut off. In the rail car embodiment shown in FIG. 1, the operator should then disconnect the flexible lateral lines 17A–D from the quick disconnect coupling at the sewage holding tanks 15A–D, the vacuum valves 18A–D, or both.

The foregoing description and figures of the present invention are directed toward a preferred embodiment of the present vacuum sewer system and a method of operating the same. It should be appreciated that various modifications can be made to each of the components of the present vacuum sewer system and the steps of operating the system. Indeed, such modifications are encouraged to be made in the materials, dimensions, structure of the disclosed embodiments of the present invention, as well as modifications in the particular order and nature of the steps of the method, without departing from the spirit and scope thereof. Thus, the foregoing description of the preferred embodiments and methods should be taken by way of illustration rather than by way of limitation.

I claim:

1. A method of operating a vacuum sewer system for withdrawing wastewater from a sewage holding tank through a lateral flow line into a main pipeline, said method comprising the steps of:

creating a vacuum environment in said main pipeline and said lateral flow line; selectively subjecting wastewater retained within said sewage holding tank to said vacuum environment for a period of time sufficient to force substantially only wastewater to flow out of said sewage holding tank and into said lateral flow line but insufficient to permit an appreciable amount of air to flow from said sewage holding tank; and selectively admitting air directly into said main pipeline thereby enhancing the flow of the wastewater flowing within said lateral flow line.

2. The method of operating the vacuum sewer system of claim 1 wherein said step of creating said vacuum environment comprises selectively activating at least one vacuum pump that is connected to said main pipeline until a predetermined vacuum environment is created within said main pipeline and said lateral flow line.

3. The method of operating the vacuum sewer system of claim 1 wherein said step of selectively subjecting said wastewater in said sewage holding tank to said vacuum environment comprises opening and closing vacuum valve means.

4. The method of operating the vacuum sewer system of claim 3 wherein said steps of selectively opening and closing said vacuum valve means are controlled by a PLC at predetermined intervals.

5. The method of operating the vacuum sewer system of claim 3 further comprising the step of cycling said vacuum valve means between said open and closed positions until a desired amount of wastewater initially stored within said sewage holding tank has been removed therefrom.

6. The method of operating the vacuum sewer system of claim 3 wherein said steps of selectively opening and closing said vacuum valve means are controlled by level detection means arranged in operative association with said sewage holding tank.

7. The method of operating the vacuum sewer system of claim 1 wherein said step of selectively admitting air directly into said main pipeline comprises opening and closing a plurality of air inlet valve means arranged at spaced distances along said main pipeline.

8. The method of operating the vacuum sewer system of claim 7 wherein said steps of opening and closing a plurality of air inlet valve means are controlled by a PLC.

9. The method of operating the vacuum sewer system of claim 7 wherein said plurality of air inlet valve means comprises a plurality of solenoid valves, and said steps of selectively opening and closing said plurality of air inlet valve means comprises sending a logic signal from a PLC to said plurality of solenoid valves.

10. The method of operating the vacuum sewer system of claim 1 wherein said step of selectively subjecting said sewage in said sewage holding tank to said vacuum environment does not occur until the vacuum level within said vacuum environment reaches between about 200 mm Hg and 600 mm Hg.

11. The method of operating the vacuum sewer system of claim 1 wherein said step of creating said vacuum environment is controlled by a PLC.

12. The method of operating the vacuum sewer system of claim 1 further comprising the step of selectively transporting wastewater within a gravity plumbing system from a plurality of initial storage tanks through corresponding gravity lateral lines into said sewage holding tank.

13. A vacuum sewer system comprising:

a sewage holding tank; vacuum valve means normally arranged in a closed position and being selectively actuatable to an open position for permitting substantially only wastewater stored within said sewage holding tank to flow therefrom while preventing an appreciable amount of air from flowing out of said sewage holding tank; lateral flow line means for transporting wastewater out of said sewage holding tank, said vacuum valve means being connected to said lateral flow line means; a main pipeline connected to said lateral flow line means to receive wastewater flowing therefrom; vacuum generating means for generating a vacuum environment within said main pipeline and said lateral flow line means; and a plurality of air inlet valve means arranged at spaced locations along said main pipeline and being selectively actuatable from a closed position to an open position and vice versa for selectively permitting ambient air to be drawn into said main pipeline by said vacuum environment therein whereby the flow of wastewater flowing within said lateral flow line means is enhanced.

14. The vacuum sewer system of claim 13 wherein said vacuum valve means is arranged between said sewage holding tank and said lateral flow line means.

15. The vacuum sewer system of claim 13 further comprising level detection means for detecting the amount of wastewater within the sewage holding tank whereby a signal may be sent to the vacuum valve means based on the amount of wastewater in the sewage holding tank to effect opening and closing of said vacuum valve means.

16. The vacuum sewer system of claim 13 further comprising controller means for controlling actuation of said vacuum valve means between said open and closed positions so that a volume of wastewater is drawn out of said sewage holding tank at selected intervals.

17. The vacuum sewer system of claim 16 wherein said controller means comprises a PLC adapted to send control logic signals to said vacuum valve means.

18. The vacuum sewer system of claim 16 wherein said controller means also controls said actuation of said plurality of air inlet valve means between said open and closed positions.

19. A vacuum sewer system comprising:

a sewage holding tank; vacuum valve means normally arranged in a closed position and being selectively actuatable to an open position and being operatively connected to said sewage holding tank for selectively permitting substantially only wastewater stored within said sewage holding tank to flow therefrom while preventing any appreciable amount of air from flowing out of said sewage holding tank, said vacuum valve means having a receiving end and a discharge end arranged downstream from said receiving end; a lateral flow line arranged to receive wastewater flowing through said vacuum valve means when actuated to said open position, said lateral flow line having a first end connected to said discharge end of said vacuum valve means and a second end arranged downstream of said first end; a main pipeline connected to said second end of said lateral flow line; vacuum generating means for generating a vacuum environment within said main pipeline and at least a portion of said lateral flow line; and a plurality of air inlet valve means arranged at spaced locations along said main pipeline and being selectively actuatable from a closed to an open position and vice versa for selectively permitting ambient air to be drawn into said main pipeline by said vacuum environment therein whereby the flow of wastewater flowing within said lateral flow line is enhanced.

20. The vacuum sewer system of claim 19 further comprising a plurality of sewage holding tanks and plurality of lateral flow lines connected to respective ones of said plurality of sewage holding tanks, each of said plurality of lateral flow lines being connected to said main pipeline.

21. The vacuum sewer system of claim 19 further comprising a collection tank arranged downstream of said main pipeline and adapted to receive wastewater therefrom.

22. The vacuum sewer system of claim 19 wherein said vacuum valve means comprises a solenoid in combination with a valve member, said solenoid being operatively connected to said valve member to obtain desired opening and closing thereof.

23. The vacuum sewer system of claim 19 wherein each of said plurality of air inlet valve means comprises a solenoid.

24. The vacuum sewer system of claim 19 further comprising controller means for controlling actuation of said vacuum valve means between said open and closed positions so that a volume of wastewater is drawn out of said sewage holding tank at selected intervals.

25. The vacuum sewer system of claim 24 wherein said controller means comprises a PLC adapted to send control logic signals to said vacuum valve means.

26. The vacuum sewer system of claim 24 wherein said controller means also controls said actuation of said plurality of air inlet valve means between said open and closed positions.

27. The vacuum sewer system of claim 26 wherein said controller means comprises a PLC adapted to send control logic signals to said vacuum valve means and said air inlet valve means.

28. The vacuum sewer system of claim 19 further comprising a plurality of initial storage tanks and a plurality of corresponding gravity lateral lines, each of said gravity lateral lines having a first end connected to corresponding ones of said plurality of initial storage tanks and a second end connected to said sewage holding tank.

29. The vacuum sewer system of claim 19 wherein said vacuum environment generated by said vacuum generating means is between about 200 mm Hg and 600 mm Hg.

30. The vacuum sewer system of claim 19 wherein said main pipeline has an inner diameter of between about three inches and twelve inches.

31. The vacuum sewer system of claim 19 wherein said lateral flow line has an inner diameter of between about one inch and four inches.

32. The vacuum sewer system of claim 19 wherein said main pipeline is arranged in a saw-tooth pattern.

33. The vacuum sewer system of claim 19 further comprising level detection means for detecting the amount of wastewater within the sewage holding tank whereby a signal may be sent to the vacuum valve means based on the amount of wastewater in the sewage holding tank to effect opening and closing of said vacuum valve means.

* * * * *